United States Patent [19]

Masui

[11] 4,222,228

[45] Sep. 16, 1980

[54] WATERPROOFED WATCHCASE CONSTRUCTION

[75] Inventor: Yasuyuki Masui, Tokyo, Japan

[73] Assignee: Kabushiki Kaisha Daini Seikosha, Tokyo, Japan

[21] Appl. No.: 46,924

[22] Filed: Jun. 8, 1979

Related U.S. Application Data

[63] Continuation of Ser. No. 846,566, Oct. 23, 1977.

[30] Foreign Application Priority Data

Oct. 28, 1976 [JP] Japan ..... 51/145262

[51] Int. Cl.[3] ..... G04B 37/08

[52] U.S. Cl. ..... 368/291; 368/294; 368/281; 368/276

[58] Field of Search ..... 58/90 R, 91, 53, 88 R

[56] References Cited

U.S. PATENT DOCUMENTS

| | | | |
|---|---|---|---|
| 2,716,328 | 8/1955 | Dinstman | 58/90 R |
| 3,849,981 | 11/1974 | Tarusawa et al. | 58/90 R |
| 3,858,388 | 1/1975 | Fu jimori et al. | 58/90 R |
| 3,950,937 | 4/1976 | Fujimori | 58/90 R |
| 4,117,658 | 10/1978 | Miyasaki et al. | 58/91 |

*Primary Examiner*—Ulysses Weldon

*Attorney, Agent, or Firm*—Robert E. Burns; Emmanuel J. Lobato; Bruce L. Adams

[57] ABSTRACT

Waterproofing of a watchcase is achieved by a sealing ring disposed between the periphery of the watch glass and a bezel portion of the case and confined between the glass holder ring on which the watch glass rests and an inturned lip portion of the bezel which retains the watch glass. By being disposed between the periphery of the watch glass and the bezel, the sealing ring is concealed from view by the inturned lip portion of the bezel and a more attractive watch is thereby achieved. A second sealing ring is provided between the bezel portion of the case and the case back to provide a seal therebetween.

5 Claims, 5 Drawing Figures

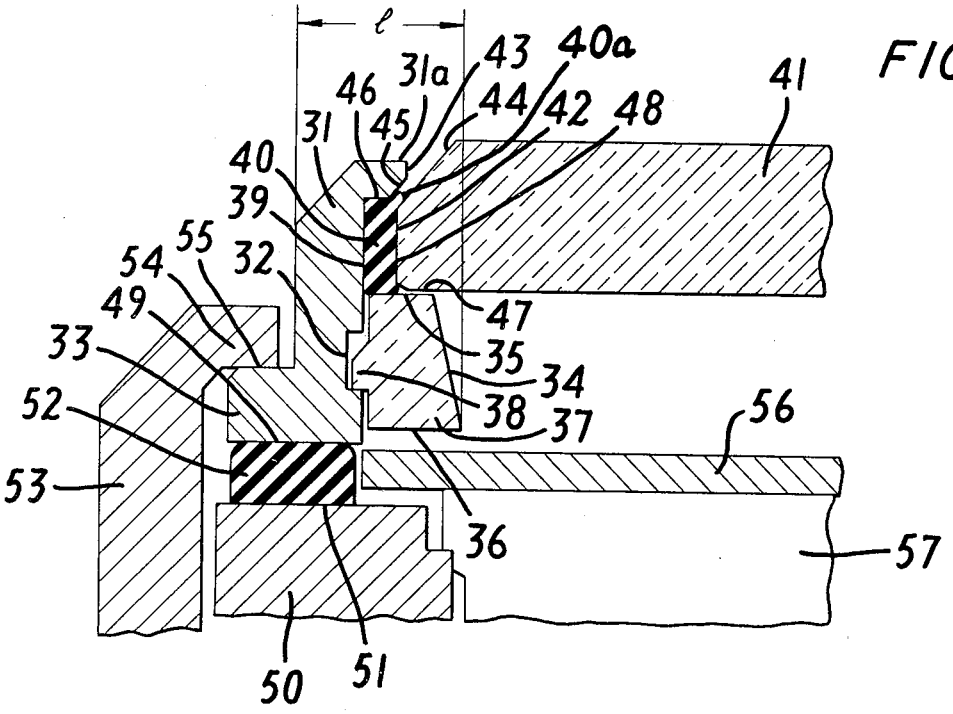
FIG. 3
FIG. 4
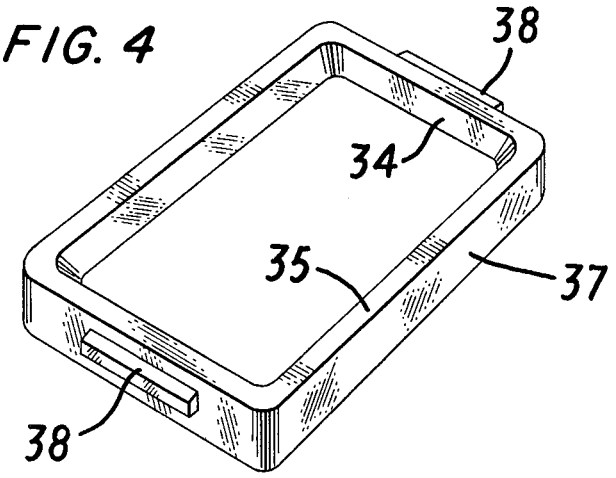
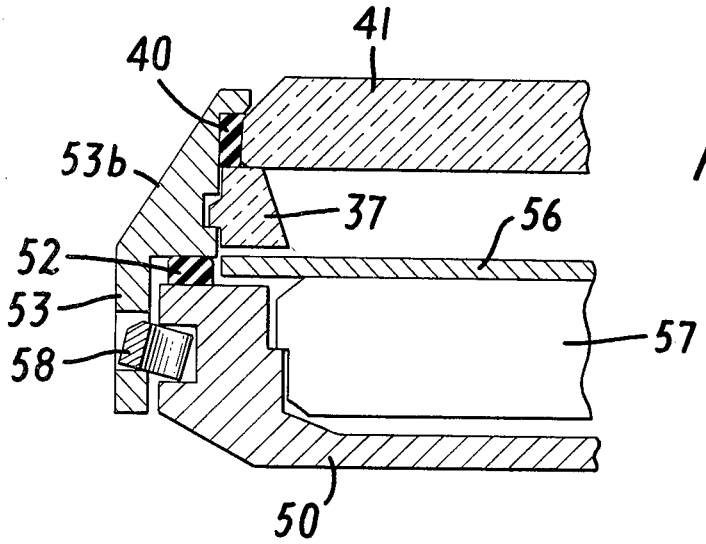
FIG. 5

WATERPROOFED WATCHCASE CONSTRUCTION

This is a continuation of application Ser. No. 846,566, filed Oct. 23, 1977.

FIELD OF INVENTION

The present invention relates to the construction of a waterproofed watchcase and especially to the glass-fitting construction of a waterproofed watchcase having a noncircular shape.

BACKGROUND OF THE INVENTION

In a conventional construction, a sealing ring is provided between a peripheral portion of the watch glass and a glass holder ring in such position that the sealing ring is visible through the watch glass. This impairs the appearance of the watch. Moreover, the shape of the assembled members, especially the glass holder ring, is so elaborate that there are difficulties in the manufacturing process and high manufacturing costs.

SUMMARY OF THE INVENTION

It is an object of the present invention to eliminate the drawbacks of prior waterproofed watch constructions and to provide a waterproofed watchcase in which the sealing ring is not exposed to view through the watchcase. A further object of the invention is to provide a simpler construction which results in decreasing manufacturing costs.

In accordance with the present invention a waterproofed watchcase construction comprises a case body having a bezel portion and a case back secured to the case body. A glass holder ring fits inside a lower portion of the bezel portion of the case and is secured in position in the bezel portion. A watch glass is seated on the glass holder ring inside an upper part of the bezel portion of the case and is retained by an inturned upper edge of the bezel portion. A first sealing ring is confined between the peripheral edge of the watch glass and the bezel portion of the case and between the glass holder ring and the inturned upper edge of the bezel portion to provide a seal between the periphery of the watch glass and the bezel portion of the case. A second sealing ring provides a seal between the bezel portion of the watchcase and the watch back. There is thereby provided a waterproofed watchcase construction of more attractive appearance and less expensive to manufacture.

BRIEF DESCRIPTION OF DRAWINGS

The nature, objects and advantages of the invention will appear further from the following description in conjunction with the accompanying drawings in which:

FIG. 3 is an enlarged partial cross section of the watchcase construction shown in FIG. 2, FIG. 4 is a perspective view of the glass holder ring of the construction shown in FIGS. 2 and 3, and FIG. 5 is a partial cross section of another embodiment of the invention in which the case body and bezel are formed integrally with one another.

DESCRIPTION OF PRIOR ART CONSTRUCTION

Figure 1:
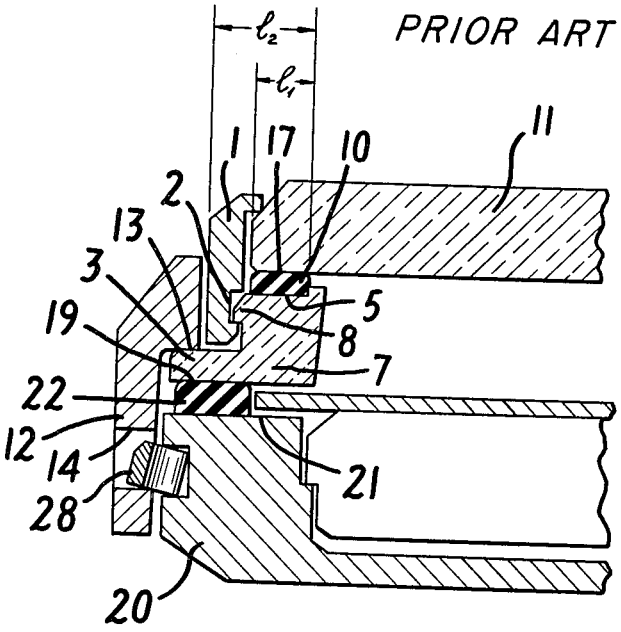
FIG. 1 PRIOR ART
FIG. 1 is an enlarged partial cross section of a waterproofed watchcase of conventional construction.

A conventional waterproofed watch construction as shown by way of example in FIG. 1 comprises a bezel 1 having in its upper portion an opening to receive a watch glass 11. A sealing ring 10 is disposed between the lower peripheral portion 17 of the watch glass 11 and the upper face 5 of a glass holder ring 7 to provide waterproofing therebetween. Near its upper surface the glass holder ring 7 has a peripheral projection 8 which is engageable with a recess 2 of the bezel 1. A second sealing ring 22 is disposed between the lower face of an outwardly projecting flange of the glass holder ring 7 and the upper face 21 of the case back 20 to provide waterproofing therebetween. A case body 12 has a shoulder 13 engaging the flange 3 of the glass holder ring 7 and openings 14 to receive spring members 28 for securing the case back 20 to the case body 12.

As the sealing ring 10 is positioned under the transparent watch glass 11 so that the sealing ring can be seen through the watch glass, this impairs the appearance of the watch. If the width $l_1$ of the sealing ring 10 is made smaller so as to improve the appearance of the watch, the waterproofing function of the sealing ring is decreased. Hence, the width $l_1$ cannot be made smaller than a certain limited dimension.

Moreover, when the sealing ring 10 is positioned under the watch glass 11 as shown in FIG. 1, the width $l_2$ between the circumferential side face of the bezel 1 and the inner face of the glass holder ring 7 necessarily becomes larger and the width of the flange 3 of the glass holder ring does necessarily increase. This results in a weakened construction. Moreover, the shape of the assembled members, especially the glass holder ring, is so elaborate that there are difficulties in the manufacturing process and the cost of manufacturing is increased. The assembly of the watch glass 11, bezel 1, sealing ring 10 and glass holder ring 7 is so elaborate that the assembling or disassembling operation of these members is technically quite difficult and when one of the assembled members, for example the watch glass 11, is damaged a complete set of preassembled members comprising the watch glass 11, bezel 1, sealing ring 10 and glass holder ring 7 must be exchanged. This brings about an increase in the cost of production and the inconvenience in later service.

DESCRIPTION OF PREFERRED EMBODIMENT

Figure 2:
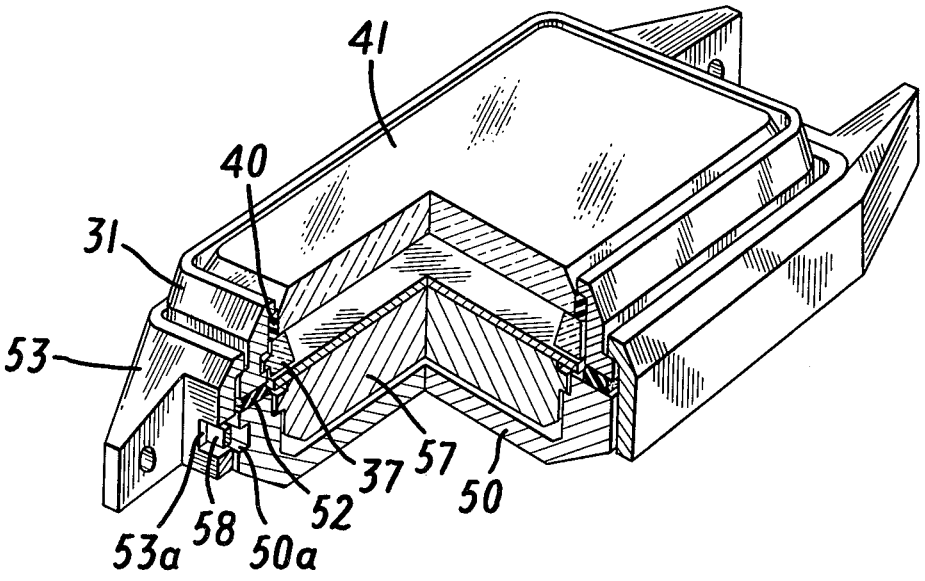
FIG. 2 is a partially cut away perspective view of a waterproofed watchcase construction in accordance with the present invention.

In the embodiment of the invention shown by way of example in FIGS. 2, 3 and 4, a bezel 31 is formed on its inner face 39 with recesses 32 and on its lower outer face with an outwardly projecting flange 33. A glass holder ring 37 has an inclined inner face 34, a flat upper face 35 and a flat rear face 36. At two or more positions the glass holder ring 37 has outwardly extending projections 38 on its outer peripheral face. The projections 38 on the glass holder ring 37 are adapted to be received in the recesses 32 on the inner face of the bezel 31. Except for the recesses 32, the inner peripheral face of the bezel 31 is substantially cylindrical.

A sealing ring 40 is mounted within the upper portion of the inner face 39 of the bezel 31 and a watch glass 41 is inserted from the lower opening of the bezel 31. A sloping face 44 formed on the upper peripheral face of the watch glass 41 makes it easy to insert the watch glass within the upper opening of the bezel 31. Next the glass holder ring 37 is inserted in the lower portion of the bezel and the projections 38 of the glass holder ring are fitted in the recess 32 on the inner face of the bezel. By the assembly of the watch glass 41 and the glass holder ring 37, the sealing ring 40 is resiliently compressed between the inner face 39 of the bezel 31 and the peripheral edge 42 of the watch glass 41 and between the glass holder ring 37 and an inturned lip portion 31*a* of the bezel 31. Consequently waterproofing is obtained between the upper inner face 39 of the bezel 31 and the peripheral edge face 42 of the watch glass 41. As the inner diameter of the inner peripheral face 43 of the inturned lip portion 31*a* of the bezel 31 is formed smaller than the outer diameter of the watch glass 41, the watch glass 41 is prevented from coming out of the bezel in an upward direction. The inturned lip portion 31*a* of the bezel 31 has an inclined inner face 45 which is spaced slightly from the sloping face 44 on the upper peripheral face of the watch glass 41. A corner portion of the sealing ring 40 is pressed inbetween the sloping face 44 of the watch glass and the inclined surface 45 of the inturned lip portion 31*a* to form an inclined bead 40*a* which limits upward movement of the watch glass. The sealing ring 40 further provides a waterproof seal between the upper surface 35 of the glass holder ring 37 and a sealing surface 46 on the underside of the inturned lip portion 31*a* of the bezel 31. The assembly of the bezel 31, the glass holder ring 37, the sealing ring 40 and the watch glass 41 can be handled as a single part which makes the assembling operation of the watch very easy. The upper surface 35 of the glass holder ring 37 is abutted both against the peripheral rear face 47 of the watch glass 31 and the rear surface 48 of the sealing ring 40 so that the watch glass 41 and the sealing ring 40 are supported in the bezel 31 by the glass holder ring 37.

A sealing ring 52 is disposed between the rear surface 49 of the bezel 31 and the upper surface 51 of a case back 50. The sealing ring 52 provides a waterproof seal between the rear surface 49 of the bezel and the upper surface 51 of the case back 50 and absorbs impact through the glass holder ring 37 and the bezel 31 when an impact or shock is applied to the watch glass 41. A case body 53 has on its upper portion an inner peripheral flange 54, the rear surface 55 of which is abutted against the upper surface of the flange portion 33 of the bezel 31. A watch movement 57 and dial plate 56 are assembled in the watch back 50 and the glass holder ring 37. Spring members 58 fitting in peripheral recesses 50*a* of the case back 50 and matching openings 53*a* of the case body 53 retain the case back 50, the watch movement 57 and dial plate 56 in assembled relation in the case body 53. The inturned peripheral flange 54 on the upper portion of the case body 53 retains the assembly comprising the bezel 31, watch glass 41, glass holder ring 37 and sealing ring 40. The sealing ring 52 provides a waterproof seal between this assembly and the watch back 50.

In FIG. 5 there is shown another embodiment of the invention in which the case body 53 and the bezel 31 of the first embodiment are formed as a single body. Thus the case body 53 has a bezel portion 53*b* in which the sealing ring 40, watch glass 41 and glass holder ring 37 are inserted. The construction is otherwise the same as that illustrated in FIGS. 2 to 4.

In the embodiments of this invention as described, the sealing ring for the watch glass is disposed between the upper inner face of the bezel and the circumferential edge surface of the watch glass so that the sealing ring is covered by the inturned lip portion of the bezel and is not exposed to view through the watch glass. A good appearance is thus obtained. Also the sealing ring is not positioned on the rear face of the watch glass so that the width between the inner face and outer face of the glass holder ring can be reduced to the limited value required for supporting the watch glass. Therefore the width between the outer face of the bezel and the inner face of the glass holder ring can be reduced and the design effect thereby further improved. Moreover, the shape of the glass holder ring is simpler than that of conventional glass holder rings. The other assembled members can be formed in about the same shape as for the usual watch case so as to simplify the manufacturing process and reduce the product cost.

The combination of the construction comprising the watch glass, the bezel, the sealing ring and the glass holder ring is so simplified that the usual repairman can easily perform the assembling and disassembling operations and the assembled parts can be prepared and provided as one body so that the servicing cost can be greatly reduced. The invention thus provides a construction which is highly convenient for servicing.

While particular embodiments of the invention have been illustrated in the drawings and are herein described, it will be understood that variations and modifications can be made and that the invention is hence in no way limited to the illustrated embodiments.

What is claimed is:

1. A waterproofed watchcase comprising a noncircular case body having a bezel portion, a case back, means for securing said case back to said case body, a glass holder ring fitting inside a rearward portion of said bezel portion of said case body and having integral projections of limited peripheral extent at opposite sides of its periphery, said bezel portion having an inner face having recesses of limited peripheral extent to receive said projections to position said glass holder ring, said inner face being a plain unindented cylindrical surface except for said recesses, a rear face which is perpendicular to said inner face and an inturned front lip having a rear face perpendicular to said inner face of said bezel portion, an inclined face sloping forwardly and inwardly from said rear face of said lip and an inner edge perpendicular to said rear face of said lip, a watch glass seated on said glass holder ring and having a front face, a peripheral edge surface parallel to and spaced from the inner face of said bezel portion and a peripheral sloping face joining said peripheral edge surface and said front face of said glass, said sloping face being parallel to and spaced slightly from said inclined face of said inturned front lip of said bezel portion, said glass being of a size larger than the area defined by said inner edge of said inturned front lip so that said glass extends beneath said lip, a first sealing ring of substantially rectangular cross section confined in an annular space defined by said bezel portion, said watch glass and said glass holder ring, said sealing ring having an inner face engaging said peripheral edge surface of said glass, a rear face engaging only the front face of said glass holder ring, an outer face engaging said plain inner face of said bezel portion, a front face engaging the rear face of said inturned front lip, and an inclined bead portion pressed into said space between said inclined face of said inturned front lip and said peripheral sloping face of said glass, and a second-sealing ring of substantially rectangular cross section confined between said rear face of said bezel portion and the front face of a rim portion of said case back.

2. A waterproofed watchcase construction according to claim 1, in which said bezel portion is integral with said case body.

3. A waterproofed watchcase construction according to claim 1, in which said bezel portion comprises a bezel ring having at its lower portion an outwardly projecting flange and in which said case body has at its upper portion an inturned flange which engages said outwardly projecting flange of said bezel ring to unite said bezel ring and case body.

4. A waterproofed watchcase according to claim 1 in which, except for said projecting, said glass holder ring is of trapezoidal cross section shape with plane front and rear faces and a cylindrical outer peripheral face.

5. A waterproofed watchcase according to claim 1, in which said watchcase including said bezel portion, case back, watch glass and glass holder ring is of generally rectangular shape and in which said projections are provided on two opposite straight side portions of said glass holder ring.

* * * * *